US005771154A

United States Patent [19]

Goodman et al.

[11] Patent Number: 5,771,154

[45] Date of Patent: Jun. 23, 1998

[54] HEATSINK ASSEMBLY FOR A HIGH-POWER DEVICE

[75] Inventors: Mitchell E. Goodman, Coral Springs; John C. Barron, Davie; Robert B. Ford, Tamarac, all of Fla.

[73] Assignee: Motorola, Inc., Schaumburg, Ill.

[21] Appl. No.: 833,018

[22] Filed: Apr. 3, 1997

[51] Int. Cl.[6] ..... H05H 7/20

[52] U.S. Cl. ..... 361/704; 174/16.3; 361/710; 361/814; 381/87; 381/90

[58] Field of Search ..... 165/80.2, 80.3, 165/185; 174/16.3; 257/707, 712, 713, 718–719; 361/704, 707, 690, 709–710, 715–721, 814; 381/87–90, 159, 193–194, 199

[56] References Cited

U.S. PATENT DOCUMENTS

| | | | |
|---|---|---|---|
| 3,991,286 | 11/1976 | Henricksen | 381/194 |
| 4,138,593 | 2/1979 | Hasselbach et al. | 381/159 |
| 4,210,778 | 7/1980 | Sakurai et al. | 381/159 |
| 4,590,332 | 5/1986 | Delbuck | 381/193 |
| 4,811,403 | 3/1989 | Herricksen et al. | 381/87 |
| 5,533,132 | 7/1996 | Button | 361/704 |

*Primary Examiner*—Gregory D. Thompson
*Attorney, Agent, or Firm*—Glenn E. Gold; Dale W. Dorinski

[57] ABSTRACT

A heatsink assembly (100) provides additional heat dissipation for a high-power integrated circuit package (102) contained within a communication product housing (130). There is an integral heatsink (104) protruding from the package. The heatsink frictionally mates with the first end (108) of a thermally conductive member (106). The second end (110) of the conductive member is magnetically-coupled to the rear surface (123) of a loudspeaker magnet (122). Tabs (111) extending away from the second end of the conductive member provide added mechanical support, preventing the second end from sliding against the rear surface of the magnet. Heat generated by the high-power device is transferred from the package heatsink, via the thermally conductive member, to the loudspeaker magnet such that heat is dissipated away from the package and toward the magnet.

13 Claims, 1 Drawing Sheet

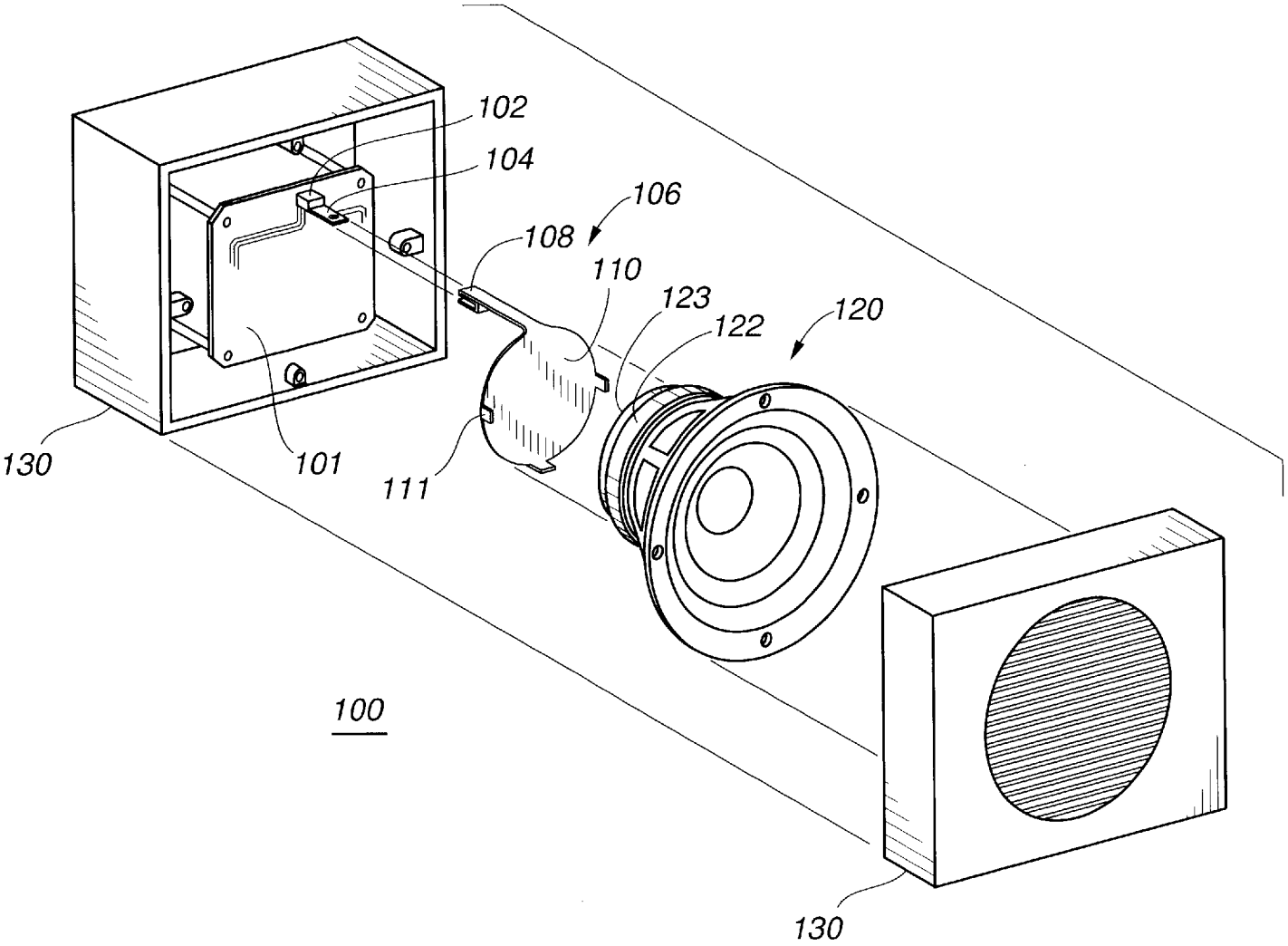
102
104
106
108
110
111
120
122
123
130
130
100
101

HEATSINK ASSEMBLY FOR A HIGH-POWER DEVICE

TECHNICAL FIELD

This invention relates in general to heatsink mechanisms and more particularly to a heatsink assembly for dissipating heat from an electronic component.

BACKGROUND

Electronic products such as two-way radios invariably contain electronic components, such as integrated circuit (IC) packages, mounted to printed circuit substrates. The substrate assembly is usually located within an inner cavity of a product housing. In operation, individual circuits on an IC generate heat, effecting an increase in the temperature of the IC. In an effort to improve performance, cost and reliability, there has been a trend toward the packaging of greater numbers of circuits in ever smaller spaces. Therefore, although the average power per circuit has been steadily decreasing with time—because of improvements in device and circuit technologies—increased circuit density and the growing total number of circuits per system have resulted in a continual increase in power and power density requirements. Semiconductor elements which are sensitive to temperature increases, e.g., transistors and diodes, may malfunction under excessive temperature; negatively impacting the operation of the circuit. In extreme cases, complete circuit failure may result. To avoid the deleterious effects of heat on IC functionality, it is desirable to maintain the junction temperature of the IC below a predetermined value. A common means of maintaining the chip temperature below such a predetermined value comprises removing heat away from the IC and the package using a heatsink.

A variety of heat sinking methods are known for dissipating heat away from electronic components. For instance, some IC packages incorporate thermally conductive heat sinks or heat fin structures bonded on the back side of the package or chip itself. Sometimes, this means of heat sinking will suffice. However, some devices, such as high-power transistors, generate excessive heat requiring greater heat dissipation. For such devices, additional heat sinking is required. For example, a high power transistor package often has an integral metal heatsink extending from the package. The heatsink has a hole which is used to mechanically fasten the heatsink, e.g., with a screw, to a nearby object having a large thermal mass. In instances where it is not feasible to directly attach the package heatsink to the thermal mass, a thermally conductive interposer may be employed; one end attached, e.g., clipped on, to the package heatsink, the other end mechanically fastened to the thermal mass. Mechanical fasteners ensure that sufficient contact pressure is maintained between the second end of the interposer and the thermal mass; in turn, ensuring sufficient thermal conduction away from the electronic component. However, the addition of mechanical fasteners to product designs is undesirable. Historically, manufacturers have driven toward product designs which eliminate the use of mechanical fasteners, since they tend to increase cycle time and cost, while decreasing product reliability.

For the foregoing reasons, it would be desirous to have a means for providing additional heat sinking in products incorporating high-power electronic components, while eliminating the need for additional mechanical fasteners.

BRIEF DESCRIPTION OF THE DRAWINGS

The sole FIGURE provided is an exploded view of a heatsink assembly in accordance with the present invention.

DETAILED DESCRIPTION OF THE PREFERRED EMBODIMENT

While the specification concludes with claims defining the features of the invention that are regarded as novel, it is believed that the invention will be better understood from a consideration of the following description in conjunction with the drawing figure.

Referring now to the FIGURE, a heatsink assembly 100 is shown for providing additional heat dissipation to an electronic component 102 contained within the housing 130 of a product having an internal loudspeaker 120. The electronic component 102 is provided upon a printed circuit substrate 101. A heatsink 104 extends from the electronic component 102. Although we envision a high-power integrated circuit (IC) package, such as a high-power transistor, the instant invention is applicable to other types of electronic components having an attached heatsink and requiring supplemental heat dissipation, i.e., in addition to the heat dissipated by the heatsink 104 alone. One skilled in the art will appreciate that there are myriad types of electronic components incorporating a wide variety of heatsink styles (e.g., see the 1995 Newark Electronics® catalog, pp. 231–234). Typically, heatsinks are manufactured from a thermally conductive metal such as aluminum. Alternatively, metal-filled polymer composites are sometimes employed. During circuit operation, component-generated heat must be dissipated to prevent damage to sensitive circuitry; the heatsink 104 acts as a thermal path away from the IC.

The heatsink 104 is attached to the first end 108 of a thermally-conductive interposer 106. Preferably, the first end 108 has a shape which is conductive to frictional coupling with the heatsink. By "frictional coupling" we mean that the first end 108 fits so tightly over the heatsink 104 that a sufficient contact force is achieved without the need for any additional fastening mechanisms, e.g., mechanical or adhesive. For instance, where a transistor-like package having a rectangular-shaped heatsink is being coupled to, it would be preferable to have a U-shaped first end which fits snugly over the outer surface of the heatsink; direct and intimate contact between the first end 108 and the heatsink 104 ensuring efficient conduction of heat from the heatsink to the connector. Clip-on and snap-on type friction mount heatsinks are well known in the art. Regardless of the heatsink shape, the first end 108 of the interposer 106 should mate with the heatsink such that there is sufficient contact force between the first end and the interposer.

The interposer 106 has a second end 110 which magnetically couples to the rear surface 123 of a loudspeaker magnet 122, precluding the need for separate mechanical fasteners used in prior art connector mechanisms. Magnetic coupling is achieved by manufacturing the interposer 106 from a material which is magnetically attracted to the magnet, i.e., a ferrous metal or alloy thereof. Preferably, the interposer 106 is stamped and formed from a single piece of ferrous metal, e.g., a metal sheet. The thickness of the metal piece or sheet will vary depending upon thermal conduction requirements for a particular application. Magnetic attraction between the second end 110 of the interposer 106 and the speaker magnet 122 is a critical feature of the invention, providing sufficient contact force without the need for mechanical fastening devices. To maximize heat conduction from the interposer 106 to the loudspeaker magnet 122, it is preferable that the second end 110 of the interposer has a surface which lies flush with the rear surface 123 of the speaker magnet 122 when the two surfaces are magnetically coupled. For instance, where the rear surface 123 of the speaker magnet 122 is planar—which is generally the case—the surface of the second end 110 which magnetically-couples to the rear surface 123 should also be planar. An alternate embodiment of the invention incorporates integral mounting tabs 111 which extend away from, and perpendicular to, the second end. The mounting tabs 111 provide added mechanical stability, preventing the second end 110 of the interposer 106 from sliding off of the rear surface 123 of the magnet 122.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims. For instance, a variation of the present invention could incorporate an interposer having a plurality of first ends for contacting a plurality of package heatsinks. Furthermore, although we envision the magnet of the present invention being provided by an internal loudspeaker, clearly magnetic attraction may be provided by alternate structures having an integral magnet, e.g., an electronic motor.

What is claimed is:

1. A heatsink assembly, comprising:

an electronic component having a heatsink extending therefrom;

a thermally conductive interposer having first and second ends, the first end attached to the heatsink; and a magnet having a thermally-conductive rear surface, the second end of said interposer magnetically coupled to said rear surface such that the second end is in direct and intimate contact with said magnet, wherein heat generated by said component is transferred from the heatsink, via said thermally conductive interposer, to said magnet such that heat is dissipated away from said electronic component.

2. The heatsink assembly of claim 1, wherein said magnet comprises a loudspeaker magnet.

3. The heatsink assembly of claim 1, wherein said thermally-conductive interposer further comprises integral mounting tabs.

4. The heatsink assembly of claim 1, wherein said thermally-conductive interposer is formed from a single piece of ferrous metal.

5. The heatsink assembly of claim 1, wherein said interposer first end is attached to said heatsink via frictional coupling.

6. A heatsink assembly, comprising:

an integrated circuit package having a heatsink extending therefrom;

a thermally-conductive interposer having a first and second ends, the first end being U-shaped and frictionally coupled to the heatsink; and a loudspeaker having an integral speaker magnet extending therefrom, said magnet having a thermally-conductive rear surface, the second end of said thermally conductive interposer magnetically coupled to said rear surface such that the second end is in direct and intimate contact with said magnet, wherein heat generated by said integrated circuit package is transferred via said interposer to said speaker magnet, said magnet providing additional heat sinking for dissipating heat away from said integrated circuit package.

7. The heatsink assembly of claim 6, wherein said thermally conductive interposer comprises a ferrous metal.

8. The heatsink assembly of claim 6, wherein said second end substantially covers the rear surface of said magnet.

9. The heatsink assembly of claim 6, further comprising integral mounting tabs extending away from, and perpendicular to, the second end of said thermally conductive interposer.

10. The heatsink assembly of claim 6, wherein said interposer is formed from a single piece of ferrous metal.

11. A two-way radio having an internal loudspeaker, the radio comprising:

an electronic component having a heatsink extending therefrom;

a loudspeaker magnet extending from said internal loudspeaker, said magnet having a thermally conductive rear surface;

a ferrous metal interposer having first and second ends, the first end frictionally coupled to the heatsink, the second end magnetically coupled to the rear surface of said magnet such that said interposer is in direct and intimate contact with said magnet; and integral mounting tabs extending perpendicularly away from said second end and toward said loudspeaker magnet, wherein heat generated by said electronic component is transferred via said interposer to said loudspeaker magnet, said magnet providing additional heat sinking for dissipating heat away from said electronic component.

12. The two-way radio of claim 9, wherein said interposer second end substantially covers the rear surface of said magnet.

13. A method for improving heat dissipation from an electronic component in a communication device having an internal loudspeaker, comprising the steps of:

providing a ferrous metal interposer having first and second ends;

frictionally-coupling the interposer first end to a heatsink extending from said electronic component; and magnetically-coupling the interposer second end to a rear surface of a speaker magnet extending from said internal loudspeaker, wherein heat generated by said electronic component is transferred away from said component, via said interposer, toward said speaker magnet.

* * * * *